US006165070A

United States Patent [19]

Nolte et al.

[11] Patent Number: 6,165,070

[45] Date of Patent: Dec. 26, 2000

[54] VIDEO GAME SLOT MACHINE PROGRAM WITH OUTPUT BASED ON OPERATOR SKILL

[75] Inventors: Ronald J. Nolte, Ft. Lauderdale; Todd C. Schnagel, Pembroke Pines, both of Fla.

[73] Assignee: BVC Technologies, Inc., Davie, Fla.

[21] Appl. No.: 09/384,815

[22] Filed: Aug. 27, 1999

Related U.S. Application Data

[60] Provisional application No. 60/098,312, Aug. 27, 1998.

[51] Int. Cl.[7] ..... A63F 9/24

[52] U.S. Cl. ..... 463/20; 273/143 R; 463/16

[58] Field of Search ..... 463/20, 21; 273/143 R, 273/138 A, 142 E, 142 F, 142 H, 142 HA, 144 R, 142 R, 243, 440

[56] References Cited

U.S. PATENT DOCUMENTS

| | | | |
|---|---|---|---|
| Re. 34,244 | 5/1993 | Hagiwara | 463/20 |
| 4,353,554 | 10/1982 | Fisher | 273/143 R |
| 4,773,647 | 9/1988 | Okada et al. | 273/143 R |
| 5,667,219 | 9/1997 | Ishibashi | 273/143 R |
| 5,697,843 | 12/1997 | Manship et al. | 463/20 |
| 5,830,069 | 11/1998 | Soltesz et al. | 463/42 |
| 5,833,537 | 11/1998 | Barrie | 463/21 |

*Primary Examiner*—Michael O'Neill
*Assistant Examiner*—Julie Kasick
*Attorney, Agent, or Firm*—Robert C. Kain, Jr.; Fleit, Kain

[57] ABSTRACT

The video game slot machine program has an output based upon operator skill and imitates a gaming slot machine. The computer program game displays at least a three grid and preferably a nine grid matrix on a monitor. The program displays video representations of peripheral segments of rotating cylinders in each grid of the matrix. A plurality of iconic images (in the preferred embodiment three sets of 27 images) are maintained in a predetermined and fixed sequence and are displayed on the "spinning" peripheral cylindrical segments. The program displays this predetermined sequence of iconic images in a grid such that no more than one complete icon and no more than a fraction part of two icons are displayed at any particular time. In another words, 100% of the icon A is displayed simultaneously with no more than about 98% of icon B. In another instance, 100% of icon A is displayed, 50% of icon B is displayed and 45% of icon C is displayed. The video game program also provides an operator triggered stop command which the program delays. The program includes a timer delaying the visual cessation of the sequential rotating iconic symbols based upon the delayed stop command. An award generator rewards the operator when one or more of the filly displayed icons, shown on the stopped cylinder, match a predetermined one of a plurality of winning combinations of icons. Preferably, delay times representing the delay between the operator triggered stop command and the visual cessation of rotation, are different for each grid in the matrix. The predetermined time delay varies for each grid in the matrix.

22 Claims, 9 Drawing Sheets

FIG. 1
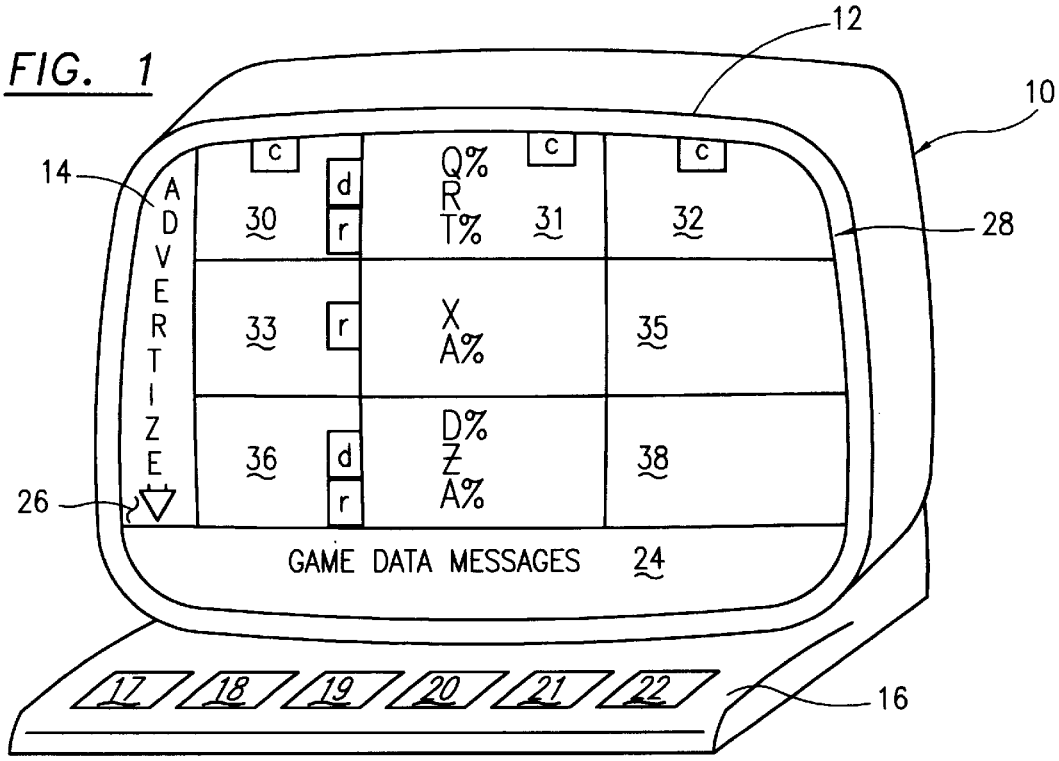
FIG. 2A
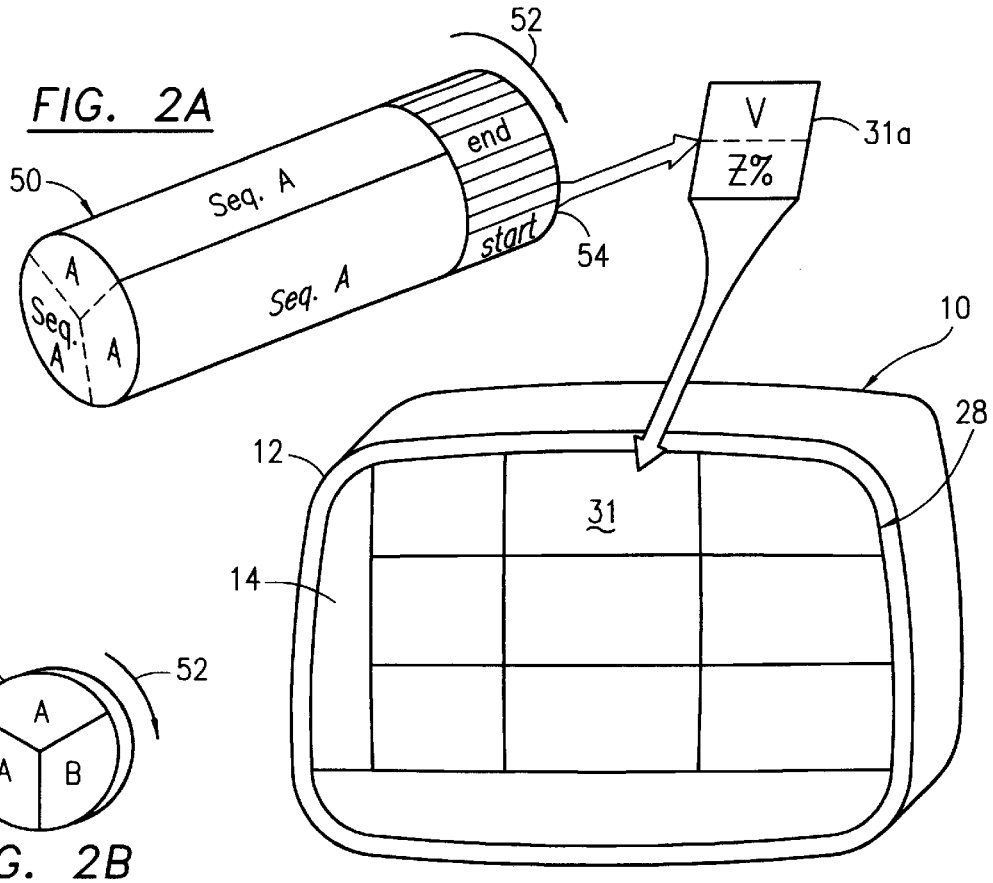
FIG. 2B

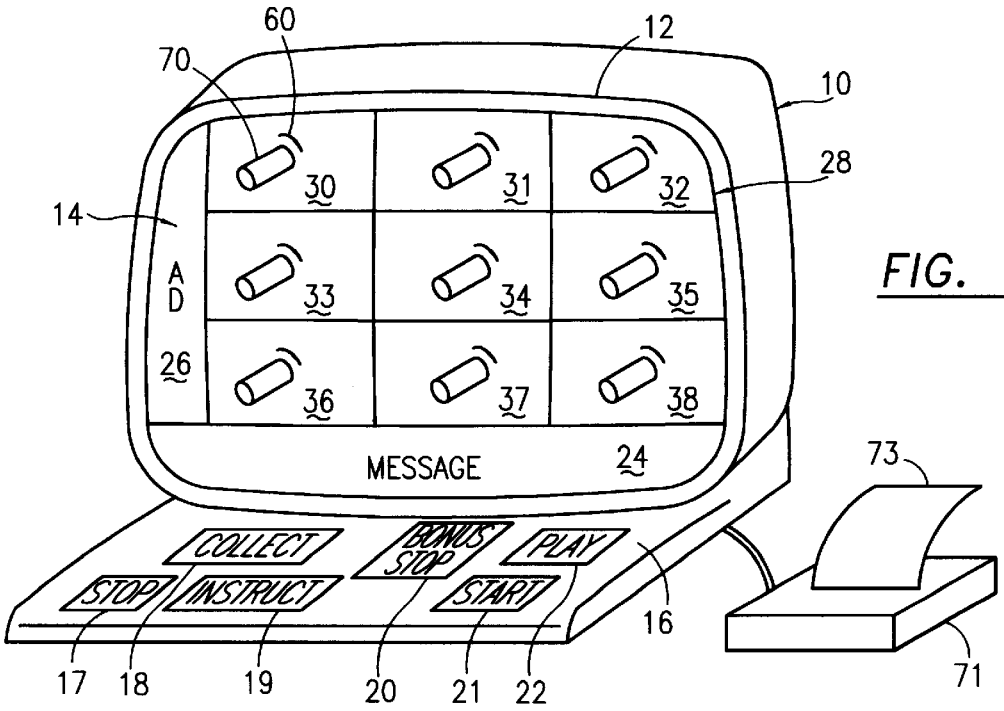
FIG. 4
FIG. 3A
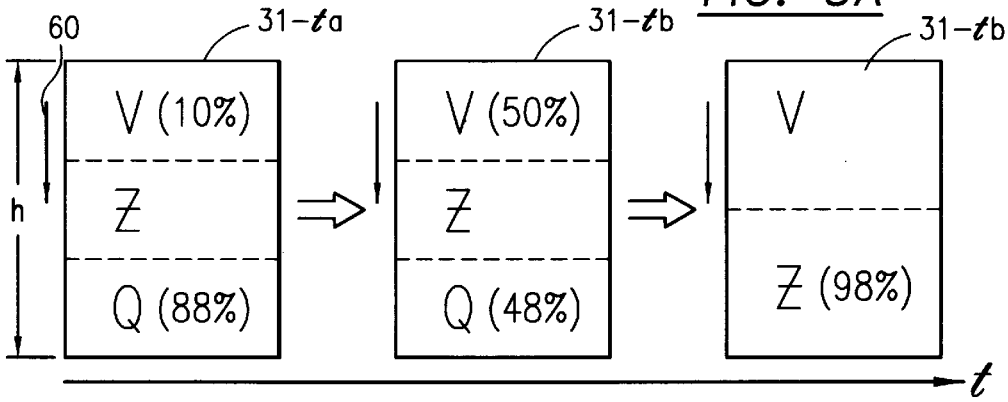
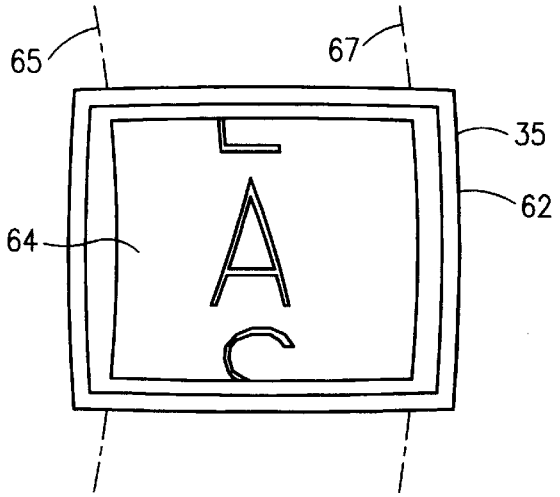
FIG. 3B

FIG. 5
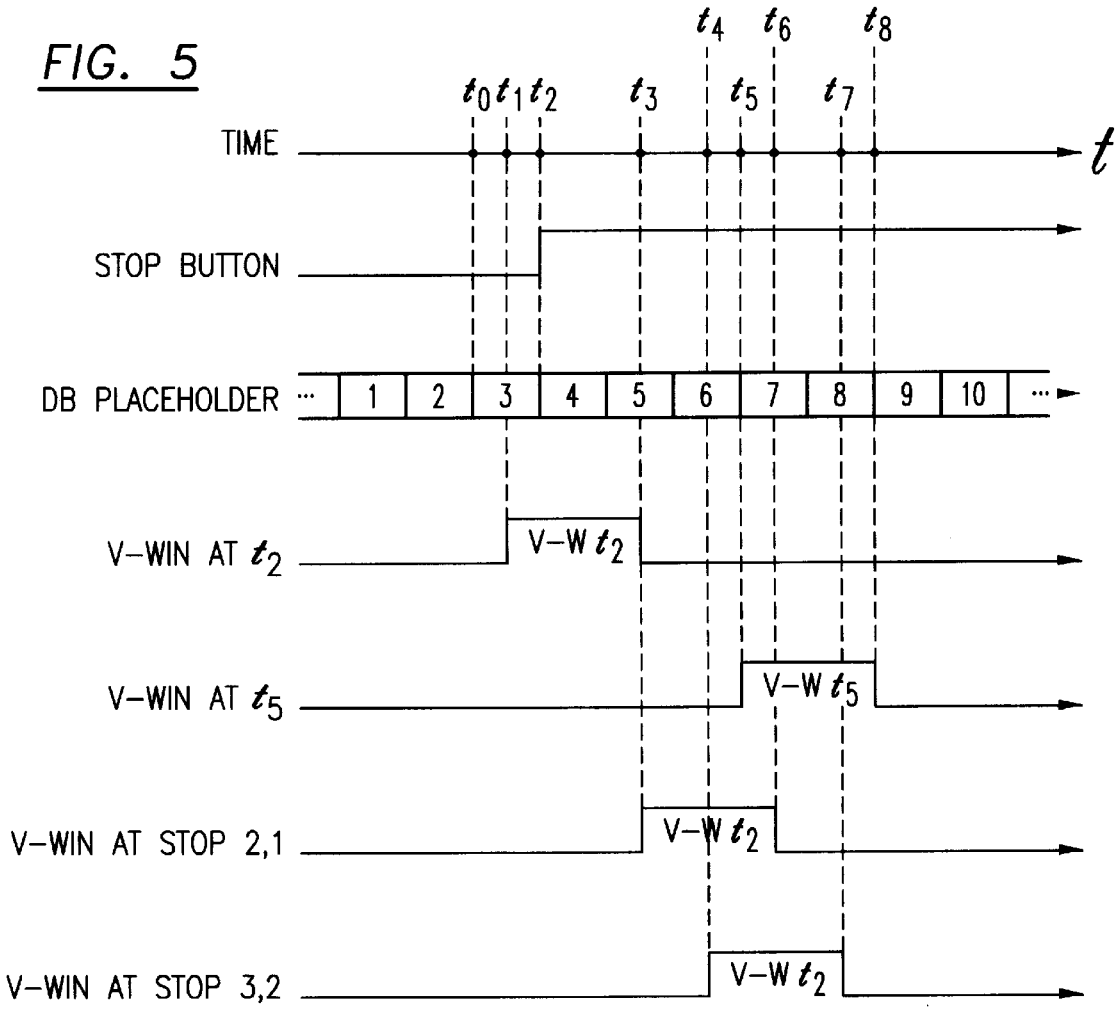
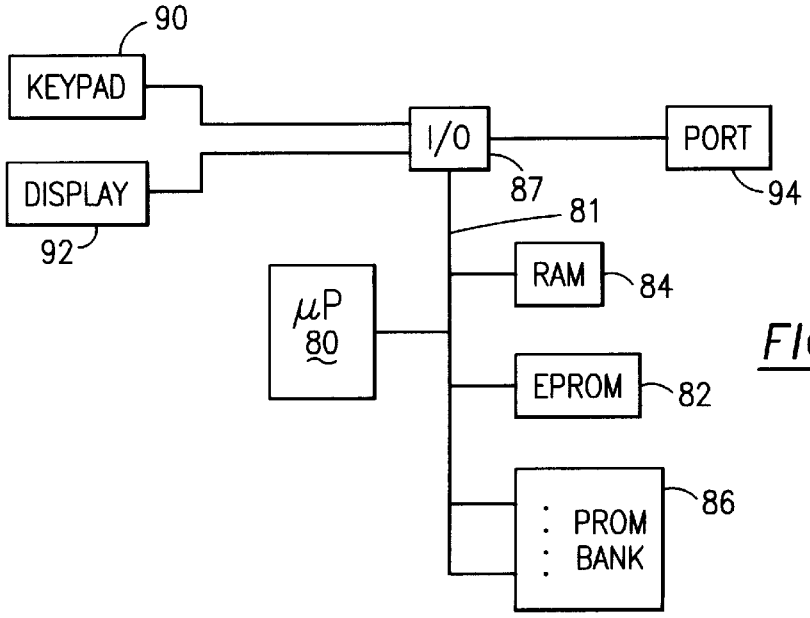
FIG. 6

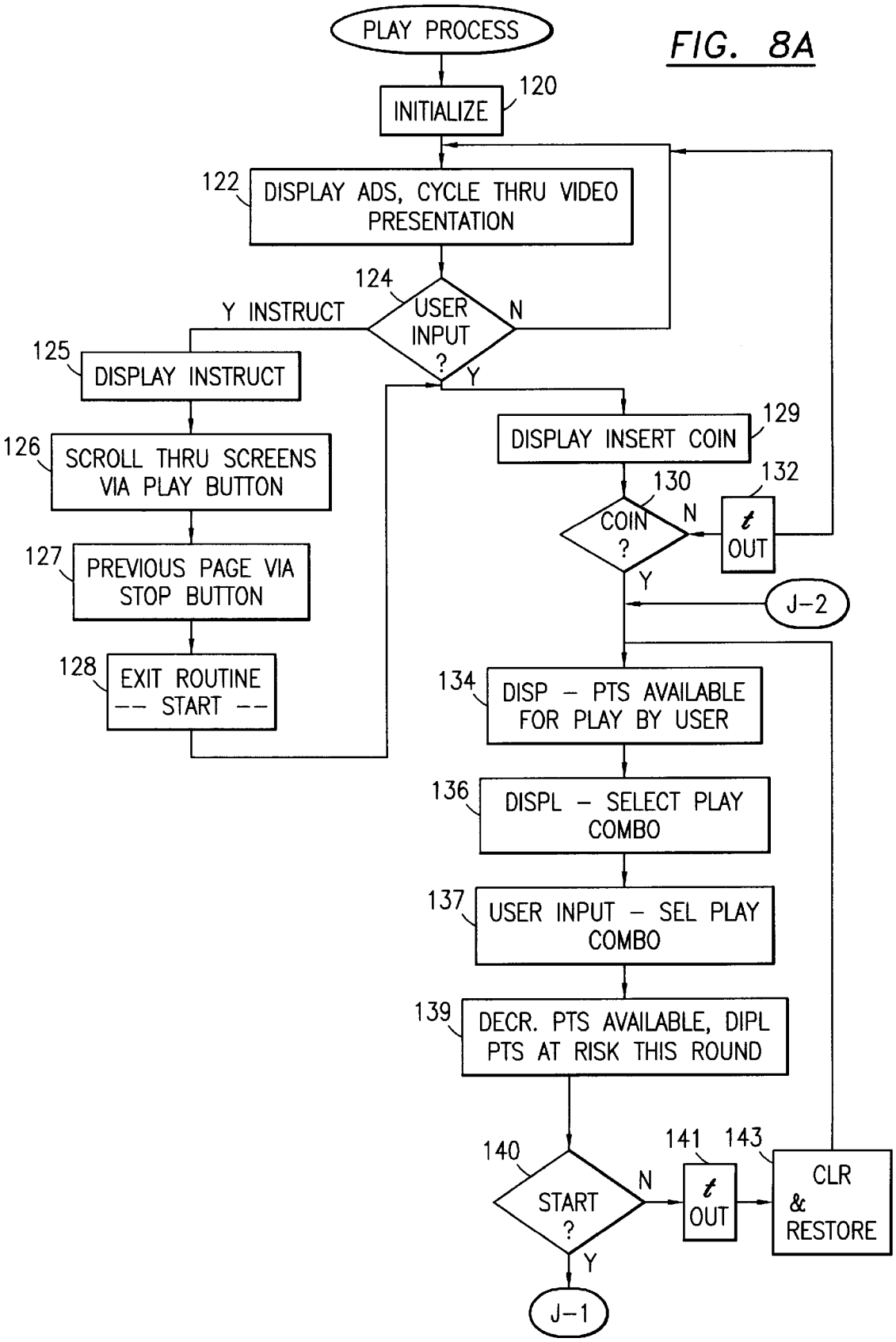
PLAY PROCESS
FIG. 8A
INITIALIZE
120
122
DISPLAY ADS, CYCLE THRU VIDEO PRESENTATION
124
USER INPUT ?
Y INSTRUCT
N
Y
125
DISPLAY INSTRUCT
126
SCROLL THRU SCREENS VIA PLAY BUTTON
127
PREVIOUS PAGE VIA STOP BUTTON
128
EXIT ROUTINE -- START --
129
DISPLAY INSERT COIN
130
COIN ?
N
Y
132
t OUT
J-2
134
DISP - PTS AVAILABLE FOR PLAY BY USER
136
DISPL - SELECT PLAY COMBO
137
USER INPUT - SEL PLAY COMBO
139
DECR. PTS AVAILABLE, DIPL PTS AT RISK THIS ROUND
140
START ?
N
Y
141
t OUT
143
CLR & RESTORE
J-1

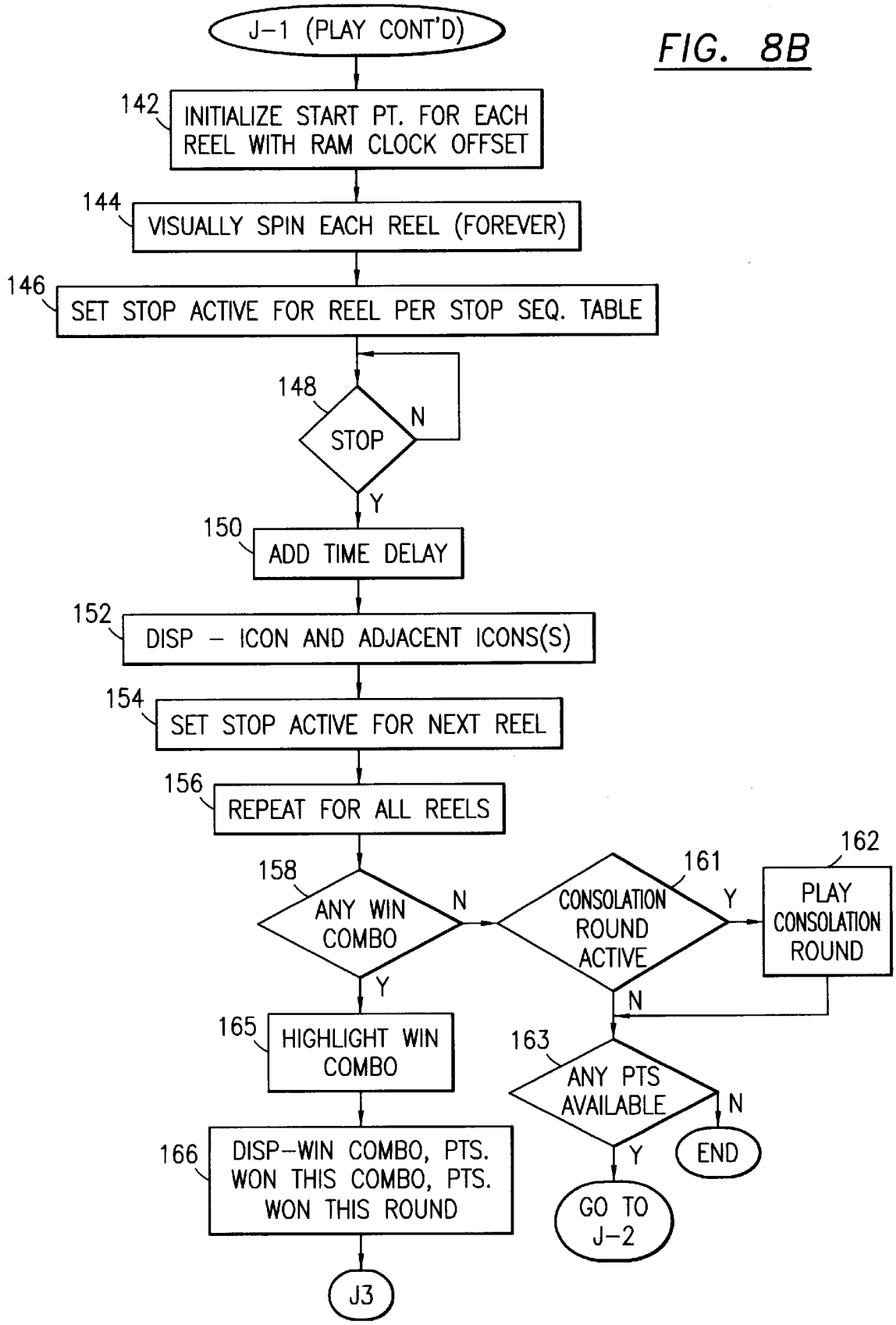
J-1 (PLAY CONT'D)
FIG. 8B
142
INITIALIZE START PT. FOR EACH REEL WITH RAM CLOCK OFFSET
144
VISUALLY SPIN EACH REEL (FOREVER)
146
SET STOP ACTIVE FOR REEL PER STOP SEQ. TABLE
148
STOP
N
Y
150
ADD TIME DELAY
152
DISP – ICON AND ADJACENT ICONS(S)
154
SET STOP ACTIVE FOR NEXT REEL
156
REPEAT FOR ALL REELS
158
ANY WIN COMBO
N
Y
161
CONSOLATION ROUND ACTIVE
Y
N
162
PLAY CONSOLATION ROUND
165
HIGHLIGHT WIN COMBO
163
ANY PTS AVAILABLE
N
Y
END
GO TO J-2
166
DISP–WIN COMBO, PTS. WON THIS COMBO, PTS. WON THIS ROUND
J3

VIDEO GAME SLOT MACHINE PROGRAM WITH OUTPUT BASED ON OPERATOR SKILL

This is a regular patent application based upon provisional application Ser. No. 60/098,312 filed Aug. 27, 1998 now pending.

The present invention relates to a video game slot machine, configured as a computer program, wherein its output is based upon operator skill rather chance.

Computer programs providing video outputs and simulated displays of slot machines are known to persons of ordinary skill in the art. Typically, these video game programs utilize a random number generator which injects an element of chance in the outcome of play. Further, many known video game slot machine programs (and devices) alter the game output and hence operator winnings based upon historic win/lost records either for the player or, more commonly, for the entire play history of the particular video game machine. For example, known video game slot machine programs deliberately alter the outcome of a round of play if the machine's win/lost ratio exceeds a certain percentage (for example, 45–48% of gross collected revenues for the machine). These known, prior art video slot machine games or computer programs have often times been classified as gambling devices by governmental authorities.

OBJECTS OF THE INVENTION

It is an object of the present invention to provide a video game slot machine program wherein its output is based upon operator skill and is not based upon chance, random number generation or other elements which may classify the video game slot machine program as a gaming or gambling device.

It is a further object of the present invention to provide a video game slot machine program which imitates a gaming slot machine but is sufficiently complex in its structure and organization that the video game output is entirely based upon operator skill. Operator skill includes his or her memory, and eye-hand coordination.

It is another object of the present invention to provide a video game slot machine program which may be implemented on a stand alone monitor and simple computing system, a personal computer (PC) or may be implemented on the global telecommunications computer network, commonly called "the Internet."

It is an additional object of the present invention to provide a video game slot machine program which can be reprogrammed to increase the complexity and diversity of the slot machine program.

It is another object of the present invention to provide a vide game slot machine program that is easy to operate and that is entertaining to users.

It is a further object of the present invention to provide a video game slot machine program wherein the sequence of iconic images presented to the operator in each grid of the matrix is fixed except during reprogramming of the entire machine.

It is another object of the present invention to provide a video game slot machine program wherein the program has a predetermined time delay which is utilized in conjunction with the illustrated (i.e., displayed) rotating cylinder bearing the predetermined sequence of iconic symbols or images and wherein the time delay is applied during a visual cessation of rotation of the cylinder (displaying to an operator a slowly rotating and then a stopped, cylinder bearing a variety of icons thereon) to the operator.

It is another object of the present invention to provide different time delays for different grids displaying different peripheral segments of rotating cylinders (those displayed peripheral segments carrying one fully represented icon and fractional images of other icons).

It is another object of the present invention to provide a video game slot machine program wherein the time delay for stopping the image of a rotating cylinder varies based upon the position of the grid in the matrix and varies based upon the amount of play time the operator has engaged with the program. However, the varied time delays are preprogrammed or fixed in the computer system. Hence, player skill determines the outcome of each round of play.

SUMMARY OF THE INVENTION

The video game slot machine program has an output based upon operator skill and imitates a gaming slot machine. The game, a computer program, displays at least a three grid matrix on a monitor. Preferably, the display includes nine grids in a square matrix. The program provides video representations of peripheral segments of rotating cylinders in each grid of the matrix. A plurality of iconic images (in the preferred embodiment 27 images) are maintained in a predetermined and fixed sequence and are displayed on the "spinning" peripheral cylindrical segments. The program, as viewed by the operator or user, displays this predetermined sequence of iconic images in the grid area such that no more than one full or complete icon is displayed at any particular time and no more than a fractional display of no more than two additional icons is displayed at the same time. In another words, 100% of the icon A is displayed simultaneously with no more than about 98% of icon B. In another instance, 100% of icon A is displayed, 50% of icon B is displayed and 45% of icon C is displayed. The video game program also provides an operator triggered stop command. The stop command is associated with each rotating cylinder. Hence, the operator selects when to stop each visually displayed rotating cylinder. The program includes a timer delaying the visual cessation of the sequential rotating iconic symbols based upon the stop command. An award generator, in the computer program, rewards the operator when one or more of the fully displayed icons, shown on the stopped cylinder, match a predetermined one of a plurality of winning combinations of icons. For example, in the preferred embodiment, 27 iconic images are sequentially arranged in a fixed sequence and that ordered, fixed sequence is repeated three times for a particular rotating cylinder. Preferably, delay times representing the delay between the operator triggered stop command and the visual cessation of rotation, are different for each grid in the matrix. In this manner, the operator depresses the stop button or keypad for a particular grid but the computer program delays the visual cessation of the rotating cylinder based upon a predetermined time delay from the depression of the stop button. The predetermined time delay varies for each grid in the matrix. In a complex implementation of the video game program, the time delay changes for each grid based upon the total amount of playing time the operator has engaged with the program.

BRIEF DESCRIPTION OF THE DRAWINGS

Further objects and advantages of the present invention can be found in the detailed description of the preferred embodiments when taken in conjunction with the accompanying drawings in which:

FIG. 1 diagrammatically illustrates the video game slot machine cabinet with a diagrammatic example of a visual display on the monitor;

FIG. 2A graphically illustrates a rotating cylinder and a presentation of iconic images on the monitor and particularly on a single grid in the matrix displayed on the monitor screen;

FIG. 2B diagrammatically illustrates the utilization of three predetermined sequences on a single rotating cylinder;

FIG. 3A graphically illustrates the rotating presentation of iconic images and particularly the fall display and fractional display of iconic images V, Z and Q at three different times;

FIG. 3B diagrammatically illustrates the video representation of a peripheral segment of a rotating cylinder in a particular grid;

FIG. 4 diagrammatically illustrates the video game cabinet and graphically illustrates rotating cylinders in each of the grids of the matrix;

FIG. 5 provides a timing diagram showing an example of the time delay and visual cessation of rotation of sequential icons in a particular grid;

FIG. 6 diagrammatically illustrates a simple electronic schematic, in block diagram form, and shows common elemental hardware associated with the video game as a stand alone unit;

FIGS. 8A, 8B and 8C diagrammatically illustrate the play process function and flowchart in accordance with the principles of the present invention;

DETAILED DESCRIPTION OF THE PREFERRED EMBODIMENTS

Figure 7:
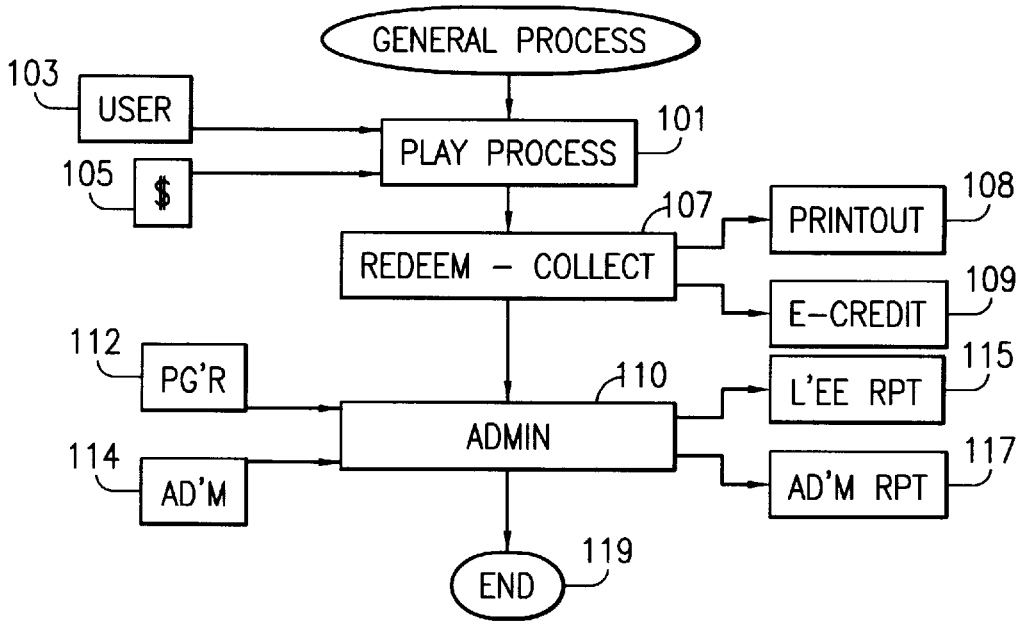
FIG. 7 diagrammatically illustrates a general process flowchart in accordance with the principles of the present invention.

The present invention relates to a video game, played with a keypad and a monitor, which imitates a gaming slot machine but generates video game output based upon play skills of an operator.

FIG. 1 diagrammatically illustrates video game cabinet 10 which includes a monitor 12 and a display screen 14. Video cabinet 10 also includes a keypad 16 having a plurality of keys 17, 18, 19, 20, 21 and 22 which are discussed in detail later in connection with FIG. 4. However, keypad 16 may include more or less keys based upon the program parameters established by the programmer implementing the video game program in accordance with the principles of the present invention. The six keys diagrammatically illustrated in FIGS. 1 and 4 represent a current working embodiment of the present invention.

Display screen 16 is, in the preferred embodiment, divided into a game data message area 24, an advertisement area 26 and a playing area which consists of a grid matrix 28. In the illustrated embodiment, a nine grid matrix is utilized. The nine grid matrix includes grids 30, 31, 32, 33, 34, 35, 36, 37 and 38. However, a basic version of the video game slot machine program can be implement on a three grid matrix consisting of grids 33, 34 and 35. The claims appended hereto are meant to cover that configuration.

Certain abbreviations are utilized in the drawings and with respect to the description of the present invention. The following Abbreviations Table provides some of these abbreviations.

Abbreviations Table

| | |
|---|---|
| % | fractional display of an icon in a video matrix - fractional display is about 3% to 95% of icon |
| admin | administrative matters |
| Ad'm | administrator |
| blk | block |
| c | column |
| clr | clear |
| combo | combination |
| d | diagonal |
| DB | database |
| decr. | decrement |
| disp | display on screen |
| gen | generate |
| incr. | increase or increment |
| L'ee | licensee (store owner, bar owner, etc) |
| pgr | programmer |
| pts | points |
| r | row |
| rpt | report |
| sel | select |
| seq | sequence |
| t | time |
| v-win | visual window |
| v-wt | visual window at time n |

Since the present invention is a computer program, some of the sequential operations relate to certain grids 30–38 in matrix 28. The following Display Matrix Grid Mapping Table provides a map coordinate chart identifying certain grid locations in matrix 28. These coordinates (for example, for grid 34, the coordinates are 2,2) are sometimes used as reference locations herein.

Display Matrix Grid Mapping Table

| | | | |
|---|---|---|---|
| column, row | 1,1 (30) | 2,1 (30) | 3,1 (32) |
| | 1,2 (33) | 2,2 (34) | 3,2 (35) |
| | 1,3 (36) | 2,3 (37) | 3,3 (38) |

In general, the present video game operates as an electronic bingo board. In order to win, the operator must place a wining combination of icons in a horizontal row 30, 31, 32 or row 33, 34, 35 or row 36, 37 and 38. However, in order to win, the user or operator (these terms are used interchangeably herein) must elect to play that particular row r, column c or diagonal d. In order for the operator to play row r 30, 31, 32, he or she must depress certain keys 17–22 in the order as prompted by the video game program, and in particular, as prompted by messages in game data message area 24. Column c includes left column 30, 32, 36; middle column 31, 34, 37; and right 32, 35, 38. Diagonals d extend and include grids 30, 34, 38 and the diagonal d from left to right includes grids 36, 34 and 32.

In order to stimulate or imitate a gaming slot machine, the vide game program displays a plurality of iconic images or icons. In FIG. 1, icon image representations are illustrated in grids 31, 34 and 37. For example with respect to grid 31, icon images Q, R and T are illustrated. The particular details of the image are discussed later. In grid 31, icon R is fully or completely displayed but icons Q and T are only fractionally displayed. Hence, the utilization or illustration herein of "Q%" refers to a fractional presentation of iconic image Q. Also as discussed later, icons Q, R, T, X, A, D, Z, A are only illustrative of the iconic images utilized in connection with the video game slot machine program. The following Master Iconic Database Table provides one example of typical icons that are displayed by the video game slot machine program.

Master Iconic Database Table

| DB placeholder | Representative Icon | Exemplary Description of Icon |
|---|---|---|
| 1 | A | |
| 2 | B | |
| 3 | C | |
| 4 | D | |
| 5 | E | |
| 6 | F | |
| 7 | G | |
| 8 | H (omit I) | |
| 9 | J | |
| 10 | K | |
| 11 | L | |
| 12 | M | |
| 13 | N | |
| 14 | O | |
| 15 | P | |
| 16 | Q | |
| 17 | R | |
| 18 | S | |
| 19 | T | |
| 20 | U | |
| 21 | V | |
| 22 | W | |
| 23 | X | |
| 24 | Y | |
| 25 | Z | |
| 26 | AA | |
| 27 | BB | |

Returning to the fractional display, in general, the fractional display of any particular icon could involve 3%–97% of the entire image of the icon. Hence, with respect to grid 34 in matrix 28, icon X is fully displayed and icon A is displayed approximately 98%. Of course, in view of moderately advanced video processing and programming techniques, the fractional percentage of displayed icons could be 99.99% of icon A. However, with respect to the discussion of the present embodiment of the invention set forth herein, the visual impact of the fractional icon is important. In other words, the mathematical percentage of the fractional icon is not critical. It is the visual presentation of the icon and whether the user or operator sees part of the icon rather than the entire icon. What is most critical is that only a single icon is fully displayed at any particular moment in a grid and for all other displayed icons (whether a single fractional icon occupying about 98% of its iconic image or two icons which fractional percentage amounts are summed to a total of 98%), the user quickly identifies fractional displayed icons from an icon which is fully displayed in a particular grid.

In order to avoid problems associated with the video game slot machine program being classified as a gaming or gambling program or device, the present invention utilizes a fixed series or sequence of icons or iconic images visually presented to the operator. Computer programming techniques utilize, in a present embodiment of the invention, a database of icons. In order to easily identify a particular icon in this description of the present invention, letters A–Z and BB (excepting I) have been assigned to the 27 icons. Of course, more icons could be utilized. Preferably, a minimum of 12 icons are utilized in the video game program. These icons, represented by letter A–BB (excepting I) herein, are located at certain memory locations in a database. Those memory locations are generally identified herein as database place holders 1–27. To display icon M, the program reads the electronic representation of icon M from memory bank location 27. Of course, "M" and "27" are only illustrative of actual icons and actual memory locations. In order to create a predetermined or fixed sequence of icons, another list or link table is established. The Partial Randomized Iconic Table—Sequence Block A shown below provides one example of a fixed, predetermined sequence of icons.

Partial Randomized Iconic Database Table - Sequence Block A

| Sequence No. | Representative Icon |
|---|---|
| 1 | E |
| 2 | AA |
| 3 | V |
| 4 | Z |
| 5 | Q |
| . . . 26 | A |
| 27 | T |

As a first example, assuming icons A–BB (excepting I) are displayed on the rotating peripheral segments of the cylinder in each grid, a sequential showing of icons at place holders 1–27 from Master Iconic Database Table are quickly recognized by the operator. The video game program in accordance with the principles of the present invention randomizes the icon list in a fixed, but random manner such that icons E, AA, V, Z and Q are presented in sequence slots 1, 2, 3, 4, 5 on a rotating cylinder in a particular grid. The use of the term "randomize" refers to the fact that icons A–BB are randomly assigned in this sequence Block A. After assignment, the sequence is fixed until the machine is re-programmed. Computer programers will recognize that sequence Block A is simply a pointer list showing the sequence to various place holders and hence images of icons from the Master Icon Database Table.

The Current Matrix Grid and Cylinder Sequence Sets in the table shown below illustrate the current embodiment of the present invention.

Current Matrix Grid and Cylinder Sequence Sets
(reference to grid coordinates)

| | | |
|---|---|---|
| AAA | AAA | AAA |
| AAA | AAA | AAA |
| AAA | AAA | AAA |

In order words, Sequence Block A (see earlier table) represents a randomized but fixed group of icons A–BB. Each sequence set or block A is reproduced three times on the rotating cylinder. Hence, from Sequence Block A Table shown above, the sequence E, AA, V, Z and Q will appear three times as the cylinder rotates.

FIG. 2A graphically shows cylinder 50 rotating in the direction shown by arrow 52. Cylinder 50 has three sequence blocks, Block A, Block A and Block A. Each sequence block begins by displaying a certain icon E. In FIG. 2A, this is shown by "start" on peripheral segment 54. FIG. 2A shows that slot numbers 3 and 4 are currently viewed on display screen 14 of monitor 12 as icons V and fractional Z. An interim graphic 31 a in FIG. 2A shows that icon V is fully displayed (100%) and icon Z% is fractionally displayed. The fractional display of icon Z is approximately 95–98%. As noted above, icons V and Z are located at adjacent sequence numbers 3, 4 and the Sequence Block A Table above.

Of course, it is not necessary to repeat sequence Block A three times. (See Current Matrix Grid Table above). The Partial Randomized Iconic Database Table—Sequence Block B which follows provides a different sequence for icons A–BB (excepting I) on the cylinders in each grid. The cylinders are referenced by the Grid Mapping Table above.

Partial Randomized Iconic Database Table - Sequence Block B

| DB placeholder | Representative Icon |
|---|---|
| 1 | D |
| 2 | A |
| 3 | F |
| 4 | N |
| 5 | W |
| . . . 26 | AA |
| 27 | L |

FIG. 2B diagrammatically shows that cylinder 50 may have displayed in connection therewith sequence blocks A, B and A. In this embodiment, each sequence block is fixed but cylinder 50 has two different sequence blocks, Block A, Block B, and the operator is shown Block A, Block A and then Block B. The following Proposal 1—Matrix Grid and Cylinder Sequence Set Table identifies various combinations for the utilization of sequence Block A and sequence Block B. In other words, grid 31 (FIGS. 1 and 2A) mapped as "column, row" coordinates 2, 1, has sequence block displayed in the following order: Block A, Block B, Block A. Grid coordinate 3, 2 (pointing to grid 35 in FIG. 1) displays sequence Block B then sequence Block B then sequence Block A. The following Proposal 1 Table is an example how a computer programmer can alter the display of the fixed sequences.

Proposal 1 - Matrix Grid and Cylinder Sequence Sets

| | | |
|---|---|---|
| AAA | ABA | ABB |
| BBB | ABA | BBA |
| BAA | BAB | AAA |

Of course, the administrator of the video game slot machine program can utilize 1, 2 or 3 different sequence blocks (Block A, Block B and Block C) and alter the order of those sequence blocks as the video game displays a peripheral segment of a rotating cylinder in each grid of the matrix. In all cases, the icons are shown in a fixed sequence on the peripheral segment of the rotating cylinder.

FIG. 3A shows grid 31 at times $t_a$, $t_b$ and $t_c$. In other words, FIG. 3A graphically illustrates the changes in the visual display of grid 31 as video iconic sequence V, Z, Q is presented in grid 31. Grid 31 has a height h and the operator is presented with a rotating iconic image sequence as shown by arrow 60. At time $t_a$, icon Q is 88% fractionally displayed, icon Z is 100% displayed and icon V is 10% displayed. At time $t_b$, icon Q is 48% displayed, icon Z is 100% displayed and icon V is 50% displayed. At time $t_c$, icon Z is 98% displayed and icon V is 100% displayed. Accordingly, FIG. 3A graphically illustrates that each grid only displays no more than one full display icon and a fractional display of no more than two icons. The display at time $t_c$ shows a full displayed icon V at a fractional display icon Z. At time $t_a$, grid 31 shows a full display of icon Z and a fractional display of icons V and Q. To the operator, it appears that the sequence of icons is rotating as shown by arrow 60.

FIG. 3B diagrammatically shows grid 35 having a black or dark border 62 and a visual presentation of a peripheral segment of a rotating cylinder 64. Icons A and fractionally displayed icon E and L are shown on the visually presented peripheral segment 64 of the rotating cylinder. To the operator, the system visually displays a rotating cylinder since left and right sides of peripheral segment image 64 are slightly curved as shown by curved lines 65, 67. Curved lines 65, 67 have the same radial center point.

FIG. 4 graphically illustrates the video game slot machine program as a stand alone unit 10 with graphic displays of rotating cylinders in grid matrix 28. As explained above in connection with FIG. 1, grid matrix 28 is visually established by the program on display screen 14 of monitor 12. Cylinder 70 is graphically illustrated in grid 30 of matrix 28. Cylinder 70 is visually rotated in a direction 60. Although cylinders are graphically illustrated in the grids of matrix 28 in FIG. 4, in reality, only a peripheral segment of a rotating cylinder, that peripheral segment shown as segment 64 in FIG. 3B, is shown in each one of the grids. Each grid is also visually delimited or identified by a dark outer border 62.

The video game program and slot machine device is commonly placed in restaurants, bars and other entertainment facilities. In order to enhance revenue of other services and products offered to the public at that facility, an advertising display space 26 is provided on display screen 14. Further, in order to keep the operator or user informed of his or her current status and play, display screen 14 includes a game data message area 24. Typical items displayed on the message area 24 are set forth below in the Game Data Table.

Game Data Table

| |
|---|
| Total Points Won |
| Winning Combinations - Points won per combination |
| Points won this round (displayed for 5 seconds, then decrements for the next 5 seconds while total points won increments) |
| Pooled Points |
| Points Available for Play by User |
| Points Currently in Play this Round |

The Game Data Table, in a preferred embodiment, shows in a left hand region, the total points won by the player or operator. On the right side of message area 24, the player is visually presented with a "points available" display. The "points available" display refers to the number of points available for the player to play or assign during any particular round play. For example and with respect to FIG. 1, the player may decide to play row r, 30, 31, 32 which represents the top row of matrix 28. If this is the only row activated by the operator during that round of play, message area 24 shows, in another area, "points currently in play this round." If each row, column or diagonal requires one point (a quarter representing 5 points available to play), the "points currently in play" would show "1."

Message area 24 also shows at certain times during the play round, a winning combination or award indicating that the operator has successfully matched a certain predetermined winning combination in a table or list stored in the video game program. Preferably, message area 24 not only shows or illustrates the winning combination, but it also shows the number points awarded for that winning combination. As an example, the winning combination for row r 30, 31, 32 may be icon sequence A-A-A (an "A" icon in each grid 30, 31 and 32). The video game program may award three points to the operator for successfully matching A in grid 30, A in grid 31 and A in grid 32.

Since it is possible for an operator to play three columns, three rows and two diagonals (eight potentially winning combinatory sets), display area 24 also includes an illustration for "points won during this round." In the current embodiment, points won during this round is illustrated for five seconds and then, in the next five seconds, the points won value is decremented while the "total points won" is incremented. As stated above, the total points won is commonly illustrated to the left of message area 24. Message area 24 may also include a "pooled points" visual indicator. The pool points present a modification of the basic program. Essentially, when certain icons appear and are stopped in a certain one of the grids, 30–38, a point value is added to the "pooled points." If the operator wins a certain combinatory set, the pooled points are then "won" and the pooled points are added to the total points won by the operator.

As used herein, an operator selects a particular icon when he or she stops the rotating cylinder (illustrated in a particular grid) and the so-called "selected icon" is the icon which is fully displayed in the visually delineated grid 30–38. For example with respect to FIG. 3A, the selected icon at times $t_a$ and $t_b$ is Z. At time $t_c$ the winning icon V.

Keypad 16 diagrammatically shown in FIG. 4 includes stop key 17, collect key 18, instruction key 19, bonus stop key 20, start key 21 and play key 22. The term "key" and "button" are used interchangeably herein. The following Keypad Table provides basic descriptions and functional aspects of these keys.

Keypad Table

| Key | Description - Functional Result |
|---|---|
| Stop | stops highlighted reel or rotating cylinder (STOP ACTIVE) |
| Collect | total points redeemed via ticket |
| Instructions | displays the primary, secondary instructions to play the game on the monitor screen; displays all the icons and the points associated with winning combinations (including wild card icons); displays the bonus round instructions, winning bonus round icons and points for each icon |
| Bonus Stop | stops bonus reel or rotating cylinder (commonly at grid matrix 2,2) |
| Start | begins rotation of all reels |
| Play | operator selects which row, column and diagonal to play (and consequently, the amount of play points at risk for that round of play). |

As explained in detail later in connection with the functional flowcharts of the program, the player is provided instructions by depressing instruction key 19. The instructions consist of primary instructions which show the icons and the points associated with each icon, secondary instructions to play the game, and instructions showing all the winning iconic combinational sets and the winning points associated with the winning sets. Customarily, certain icons represent wild card icons. For example, a wild card icon may be J (representing a Joker). The operator may win three points by selecting icon set AAA in row 30, 31, 32. The operator may win the same three points with the combination set AJA. Further, certain icons may constitute "automatic winners" not withstanding the presence or absence of other icons in the other windows. Also, it should be noted that a blank space may be substituted for any particular icon. The absence of an iconic image is substantially equivalent to the presence of an iconic image. Customarily, the iconic images are separated by horizontal image bars in order to imitate or simulate a mechanical slot machine with a rotating cylinders or reels. The terms "reels" and "cylinders" are used interchangeably herein. The instructions also provide instructions regarding bonus rounds and winning bonus round icon values and points for each of the plurality of winning bonus round combinations of icons.

It is important to know that the instructions do not show the fixed sequential list of icons which are visually presented to the user.

It is also important to know that the utilization of a theoretical rotating cylinder is simply an intellectual construct employed herein to describe the sequential presentation of icons. The system does not include physically rotating cylinders.

As explained later in connection with FIG. 6, all the icon images are permanently stored in video memory. The processor and working memory RAM maintain a list pointing to the video memory holding the icon image. An other list establishes the sequence of presentation. In order to visually display an icon image, the processor issues a command, the electronic data from the video memory for the icon is loaded into the input/output of the video memory and lines of code are read from the video memory, converted by another input/output circuit and displayed line by line at the appropriate location on display screen 14. That appropriate location is within one of the grids 30–38. Dark demarcation lines 62 (FIG. 3B) are also small video graphics which are periodically refreshed on display screen 14 at a much lower rate than the rotating video image of the icons. For example in connection with the icon sequence Q, Z, V in FIG. 3A at time $t_b$, as new lines for the video image of icon V are fed into the input/output video memory board, an equivalent amount of image data from icon image Q is "dumped" or over written in the video memory. These video processing and graphic processing techniques are known to persons of ordinary skill in the computer art. The intellectual construct of a rotating cylinder is a convenient method to discuss the present invention for two reasons. First, the operator is displayed a system which looks like rotating cylinders wherein peripheral segments of a rotating cylinder are shown rotating in each one the grids 30–38 of matrix 28. Second, the fixed sequence of iconic images is best understood by discussing those images as being displayed on a rotating cylinder. Of course, the display screen 14 is flat and the images are only represented by electronic data (zeros and ones) which are converted into appropriate electromagnetic signals to illuminate display screen 14. In reality, no physical cylinders rotate anywhere in connection with the video game program of the present invention.

Returning to FIG. 4, after the user reads the instruction or if the user wants to begin play, upon depression of play key 22, the user is prompted to input a coin. This is described later in connection with the flowchart for the present invention. Upon insertion of the coin, the user depresses the play button in order to select one or more of rows r, columns c or diagonals d (discussed above in connection with FIG. 1) and then depresses the start button 21 which causes all the peripheral segments in grids 30–38 of matrix 28 to begin rotating. If the user does not depress any further keys after the start 21 key, the cylinders in each one of the grids 30–38 continue to rotate. In other words, there is no timeout for the rotating cylinders.

In all prior art devices, there is a timeout which forces the operator to select the stop button 17 in connection with one or more of the rotating cylinders in grids 30–38. In prior art machines, a timeout is imposed in order to force the operator to play additional rounds and, hence, spend more money at the video game.

In the present invention, a gaming device is not provided and the cylinders, or the visual presentation of a peripheral segment of those cylinders, continues to rotate in grid systems 30–38.

The user stops one or more of the rotating cylinder in grid 30–38 by depression of stop key 17. In fact, the depression of the stop key 17 sets a "STOP ACTIVE" command. This stop active command is utilized by the timer in the program such that the visually displayed rotating cylinder stopped at a predetermined time after the user depresses stop button 17. This feature is discussed later in connection with the timing diagram of FIG. 5. The time delay associated with each one of the grids 30–38 is different although all the delay times relate to the passage of 1, 2, 3 or 4 full frame iconic video images through grids 30–38. Of course, the computer program does not monitor the full passage of an entire video image of an icon. Rather, the computer program utilizes a timer and the timer permits passage of the visual display of a full iconic image. This is a predetermined, programmed time. The time delay and the visual cessation of the rotating cylinder in any one of the grids 30–38 is pre-programmed. This programmed cessation of rotation is discussed later in connection with the flowcharts.

FIG. 4 also shows a printer device 71 electronically connected to device 10 which embodies the video game slot machine program. Printer 71 generates a coupon 73. Coupon 73 is generated when the user selects collect button 18. Collect button 18 transfers all the total points won by the operator to an award generator in the video program. The award generator causes the microprocessor in machine 10 to generate a coupon 73. For example, if the device 10 is located in a restaurant, coupon 73 may provide for a free soda which may be equivalent to fifty points won by the operator.

As described later, the video game computer program can be configured to be run or executed on a personal computer or PC. The following Keypad—Keyboard Conversion Table provides one example of the conversion of various keypad buttons to keyboard keys.

Keypad - Keyboard Conversion Table

| Keypad button | Keyboard key |
|---|---|
| Stop | Shift A |
| Collect | Alt. Q |
| Instructions | Control I |
| Bonus Stop | Shift B |
| Start | Enter |
| Play | Control P |

If the computer program of the present invention is stored on an electronic medium (floppy disc, RAM memory, hard drive, CD-ROM or DVD ROM), the personal computer can, after the program is initialized and placed in the PC, be utilized in the manner described hereinafter. The differences between the PC program and the present invention are discussed later in connection with PC process flowchart in FIG. 11.

In the working embodiment of the present invention, the operator is presented with the ability to activate or place in play certain rows, certain columns and certain diagonals in a predetermined manner. The following Play Combination Sequence Table provides an example of this play sequence.

Play Combination Sequence

| Play Sequence (based on depression of PLAY button) | row/column/diagonal | Grid Coordinates |
|---|---|---|
| 1 | middle row | 1,2; 2,2; 3,2 |
| 2 | top row | 1,1; 2,1; 3,1 |
| 3 | bottom row | 1,3; 2,3; 3,3 |
| 4 | first diagonal | 1,1; 2,2,; 3,3 |
| 5 | second diagonal | 3,1; 2,2; 1,3 |
| 6 | left column | 1,1; 1,2; 1,3 |
| 7 | middle column | 2,1; 2,2,; 2,3 |
| 8 | right column | 3,1; 3,2; 3,3 |

In the current embodiment, the user is permitted to place into play or transfer points "available for play" displayed in message area 24 to the area "points currently in play this round" in the sequence shown above. In other words, the user can select to play the middle row or grid 33, 34, 35 (column, row coordinates 1, 2; 2, 2; 3, 2) or may select to play other rows, columns or diagonals. The alphabetic identifiers r, c and d shown in FIG. 1 are highlighted before the user depresses the play key in order to place select and play any particular row and column. Hence, the row marker r in grid 30 is illuminated when the operator wants to play grids 30, 31 and 32. The operator then depresses the play key. This is play sequence No. 2 in the Play Combination Sequence Table listed above.

The bonus stop button 20 is utilized to stop a rotating cylindrical presentation of icons during a certain bonus round. During the bonus round, the operator, using his or her skill, attempts to select a high value icon as compared with a low value icon, and attempts to stop the rotating cylinder at the high value icon. If he or she is successful, he or she is awarded higher value winning points. However, it should be noted that the bonus round is only activated during certain portions of the play after the operator has won or matched certain icons in matrix 28.

In a preferred embodiment, a sequence of 27 icons is utilized. That predetermined sequence of icons is repeated three times on each cylinder. In order embodiments, a minimum of 12 icons are utilized on each particular rotating cylinder. However, the sequence of those icons can be shifted from predetermined sequence A to predetermined sequence B to predetermined sequence C. Further, in another embodiment, certain iconic images can be repeated in a particular sequence. Other iconic images may be omitted or a blank screen may be provided in a particular place holder in place of a certain icon image.

In a preferred embodiment, the rotating cylinder visually appears to rotate at a constant speed. Currently, it takes 4.5 seconds to cycle through the triple sequence Block A (containing 27 icons) on a single cylinder. Typically, cyclic times to display a complete sequence range from 1.5 seconds to 1.8 seconds.

FIG. 5 is a timing diagram showing the time delay for the cessation of rotation of the cylinder bearing a plurality of iconic images in a predetermined sequence. Again, the intellectual concept of a "rotating cylinder" is simply a convenient way to describe the present invention. The time delay is, in contrast to the theory of a rotating cylinder, a physical aspect of the present invention. In other words, when the operator depresses stop button 17 (FIG. 4), the video game computer program does not immediately stop the rotating image in one of the grids 30–38 (selected in a predetermined manner discussed below). The timer delays the cessation of a rotating video image. FIG. 5 provides a timing diagram showing examples of this predetermined time delay. At arbitrarily start time $t_0$, the computer program is fully displaying the icon at database place holder 3. That icon at database place or location 3 is fully displayed in one of the grids 30–38 from time $t_0$ through time $t_2$. Assuming a high level of operator skill, the stop button is depressed at time $t_2$. This is the time when the icon at database location 4 begins to be fully displayed. At time $t_2$, the visual window V-Win at one of the grids 30–38 shows, for example, 50% of the icon at database location 3, 100% of the icon at database location 4 and 50% or 45% of the icon at database location 5. Hence, the visual window at time $t_2$ spans database locations 3, 4 and 5. Of course, these database locations are not sequentially organized. Accordingly, the visual window at time $t_2$ could be the window shown in grid 31 in FIG. 3A at time $t_b$. In FIG. 3A, the visual window at time $t_b$ shows 50% of icon V, 100% of icon Z, and 48% of icon Q. Icon V is equivalent to database location 3. Icon Z is equivalent to database location 4. The partial illustration of icon Q is represented by the portion of database location 5 in FIG. 5.

At time $t_5$, the video window shows the icons at database locations 7 and 8. This is generally equivalent to window 31 shown in FIG. 3A for time $t_c$ (at that time, 100% of icon V is visually presented to the operator and 98% of icon Z is visually presented to the operator in grid 31). Again assuming a highly skilled operator, the operator has depressed the stop button at time $t_2$. This is the time equivalent to the full display of the icon at database location 4. This video program system includes a time delay wherein two video images or the time equivalent for two video images passes from stop button time $t_2$ until video stop time $t_3$. In other words, if the operator wants to stop the spinning cylinder at icon database location 6, he or she would be successful. At visual window stop 2, 1, the rotating cylinder has ceased rotation at time $t_3$. In that video display at video window $t_2$, a partial display of the icon at database location 5 and 7 is presented. A full display of the icon at database location 6 is presented to the user in that grid.

The time delays set forth herein are referred to as fall video frame time delays (a single frame for each icon). The program may use fractional time delays, for example, one-half of a video frame time period.

The cylinders stop in a predetermined sequence. The grid at column and row "2,1 " is the second programmed STOP ACTIVE grid. This feature is apparent from the following Programmed Stop Sequence for Display Grid Table.

| Programmed Stop Sequence for Display Grid Table numerals indicate STOP ACTIVE set ON | | |
|---|---|---|
| 4 | 5 | 6 |
| 1 | 2 | 3 |
| 7 | 8 | 9 |

The Programmed Stop Sequence Table above and the Programmed Time Delay Table below shows, for example with respect to the grid at column, row 2-1, that the program time delay is two video frame time periods after the user depresses stop button 17. Two video frame time periods is the time difference between time $t_1$ and time $t_3$ in FIG. 5. The visual window stop for grid 3, 2 from the Programmed Time Delay Table below shows a three video frame time period delay for grid location 3,2. This grid is the third sequential stop (see Stop Sequence Table above). This three video frame time period delay is shown as the difference between time $t_1$ and time $t_4$. As described earlier, the view, provided to the operator, for each video or visual window in one of the grids 30–38 spans slightly less than two video frames. As discussed above in connection with FIG. 3A, 100% of video frame for icon V is shown in grid 31 at time $t_c$ and 98% of the video frame for icon Z is shown at the same time.

Accordingly, if the operator depresses the stop button at $t_2$ for grid coordinate 2, 1, the visual display stops rotating two video frame time period later at the mid-point of database location 5, fully displays database location 6 and partly displays video image data from database location 7. This spans time period $t_3$ through $t_6$.

The time delay for each stop command for each grid 30–38 is shown below in the Programmed Time Delay Table.

| Programmed Time Delay From STOP Command - Display Grid Table per video frame | | |
|---|---|---|
| 1 | 2 | 1 |
| 2 | 1 | 3 |
| 3 | 1 | 3 |

To provide an increase or a decrease in the level of complexity for operators, the video game computer program may include a player clock which counts the amount of time a particular player has engaged the machine. This feature is described later in connection with the flowcharts. The Time Table for Difficulty Level Progression set forth below provides an example of fixed, but programmed, variable time delays.

Time Table for Difficulty Level Progression

| Total Play Time | Level |
|---|---|
| 0–12 min. | 1 |
| 12–20 min. | 2 |
| 20–30 min. | 3 |
| +30 min. | for every 10 min. play time, cycle through levels 1, 2, and 3 |

For example, if a player plays the video program game for 0–12 minutes, he or she experiences a Level 1 time delay. The Programmed Time Delay Table set forth above is an example of a Level 1 program time delay. If the player plays the game 12–20 minutes, the time delay for each cessation of rotation for each grid changes. The following Level Progression Programmed Time Delay Table provides an example of this type of change in time delay.

| Level Progression Programmed Time Delay From STOP Per Video Frame Difficulty Levels 1, 2 and 3 | | |
|---|---|---|
| 1, 3, 4 | 2, 3, 1 | 1, 3, 1 |
| 2, 2, 3 | 1, 3, 1 | 3, 2, 1 |
| 3, 2, 1 | 1, 2, 3 | 3, 3, 3 |

As is apparent by comparing the Level Progression Programmed Time Delay Table and the Programmed Time Delay Table, both set forth above, for Level 1, the time delays for each grid are identical. If a player plays the game between 12–20 minutes, Level 2 is initiated. At Level 2, grid position 1,1 experiences a three video frame time period delay. This is equivalent to the time period between stop button $t_2$ and the cessation of the video window at time $t_4$ at visual window stop 3, 2 in the time line identified in connection with FIG. 5. For players that operate the game 20–30 minutes, Level 3 is actuated. At Level 3, grid position 1, 1 as a four video frame time delay. If the player plays the video game more than 30 minutes, for every 10 minutes of play, the system cycles through Levels 1, 2 and 3. Of course, different levels of progression and different combinations of levels of progression and time delays can be pre-programmed without difficulty.

FIG. 6 diagrammatically illustrates the major electronic hardware components of the video game device 10. Only major items are identified in FIG. 6. Persons with ordinary skill in the computer art will recognize that other electronic sub-systems may be necessary. Microprocessor 80 controls the operation of a program primarily stored in erasable programmable read only memory EPROM 82. Temporary memory is provided by RAM 84. A prom bank 86 generally contains video memory. Microprocessor 80 is connected to memory banks 82, 84 and 86 via a common bus 81. Input/output device or devices 87 provide input/output handling tasks between keypad 90, display 92 and an electronic output port 94. In the current embodiment, prom bank 86 is configured as follows.

| Prom Bank Table (exemplary) | |
|---|---|
| text and small graphics | 3 × 256k |
| large graphics | 4 × 64k |

Although the sequence of icons is fixed or predetermined (see Sequence Block A and Sequence Block B Tables above), the starting point for each grid is different. In other words, in the current embodiment, a single, predetermined fixed sequence of 27 icons is utilized. That set of 27 sequential icons is repeated three times on a cylinder. See the Current Matrix Grid and Cylinder Sequence Sets Table set forth above. Since a single list of pointers of 27 icons is repeated three times and is stored in the memory for each cylinder (all cylinders are currently identical), it is only necessary for the current embodiment to have different start points for each rotating cylinder in grids 30–38. These different start points are achieved based upon triggering and offset from the RAM clock. A RAM clock is simply a clock that triggers the exchange of data between microprocessor 80 and RAM 84. It is a periodic timer clock which is commonly utilized by computer programmers. Also, the technique of utilizing the RAM clock to provide an offset in order to select the start point for each different cylinder from a single database or list is well known in the programming art. It should be noted that the starting point for each of the rotating cylinders does not inject a degree of chance or randomness into the entire system. It is the depression of stop button 17 by the user which generates rewards via the video game award generator and which is based entirely on the skill of the operator. The skill of the operator is enhanced if the operator can remember the sequential order of the icons on each cylinder and can remember the time delay for the stop for each grid.

Even in the enhanced version of the video game program where the time delays change based upon the amount of time a player plays the game, those time delays are (a) reasonable since they are video frame time periods between one video frame and four video frames; (b) easily identifiable since the visual presentation of icons is limited and may include as many as three icons (one fill and two partial views); and (c) the sequence of the icons as they are presented on each cylinder is fixed. As is known by persons who play video games, if the person focuses on one icon and memorizes sequences 2, 3, 4 place holder locations before and after the targeted icon, he or she can easily stop the video game program at or near the desired icon within those memorized frames.

FIGS. 7–10 diagrammatically illustrate functional flowcharts showing major functional items of the video game program. Programmers of ordinary skill in the art may reorganize the sequence of these programs. However, FIGS. 7–10 adequately describe the general flow and the major functions of the program in sufficient detail to describe the best mode of the invention, the preferred embodiment, and the techniques to create and utilize the present invention.

FIG. 7 diagrammatically illustrates the general process function of the system. Play process function 101 is executed first. User input 103 and monetary input 105 is required in order to execute or operate play process function 101. Subsequent to play process 101, redeem and collect process 107 is executed. The redeem and collect process is triggered by depression of collect button 18 in FIG. 4, generates a computer printout 108 and/or an electronic credit 109. The electronic credit may include an electronic credit to purchase other goods or services or coupon for goods and services from an online Internet service. Alternatively, the E credit may result in the operator's name being placed on a reputation chart or a "hall of fame." These features are encompassed by the claims appended hereto. Subsequent to the redeem and collect function 107 is an administrative function 110. Programmer 112 and administrator 114 have inputs into administration function 110. As It outputs, administrative function 110 generates a report to the licensee (the retail establishment owner in which video game device 10 is located) as part of a licensee's report 115. Further, administrative function 110 generates an administrator's report 117. The general process function ends at end step 119.

Figure 8C:
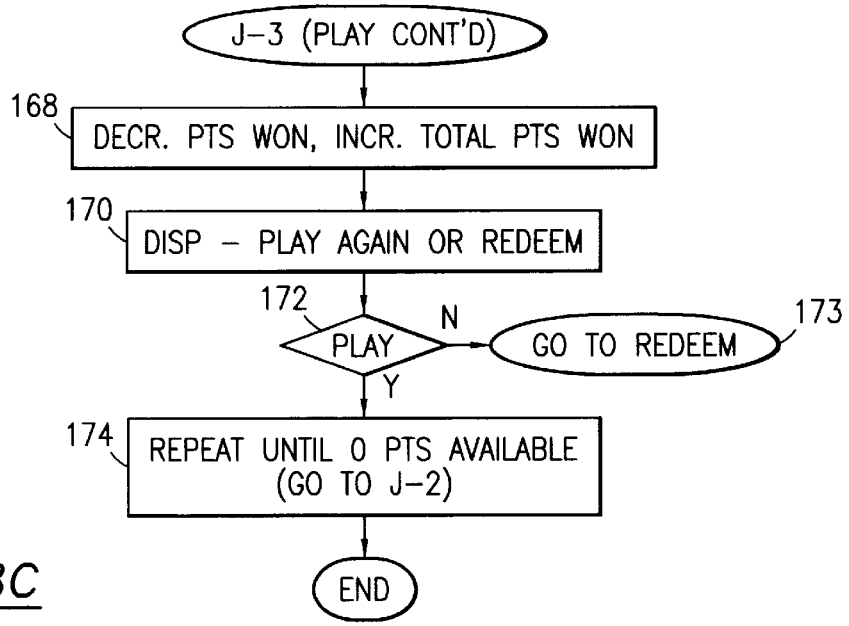

FIGS. 8A, 8B and 8C diagrammatically illustrate the functional aspects of the play process. Step 120 provides an initialization of the system. This initialization includes a check of all the hardware components shown in FIG. 6 and a check of all the video memory and memory units in RAM 84. Step 122 displays ads and advertising space 26 (FIG. 1) and cycles through a video presentation generally located in the grid space occupied by grids 30–38 and particularly in matrix area 28. This video presentation represents a "teaser" to causal viewers in order to stimulate or prompt a potential user to begin play on the video game device.

Step 124 decides whether the user has selected an input. If not, the NO branch is taken and the system cycles back to a point immediately preceding display ad step 122. If the YES-INSTRUCT branch is taken, the user has selected instruction button 19. The system then executes display instruction step 125. In step 126, the system scrolls through screens via the user depressing play button 22 (FIG. 4). Alternatively, the system could automatically scroll through via video presentation the instruction list. Step 127 determines whether the user wants to select a previous page by depression of stop button 17. In step 128, the user can exit the instruction routine by selecting the start button 21.

Returning to decision step 124, or and after exiting the instruction branch 125, 126, 127 and 128, the system executes a display function "insert coin" in step 129. Step 130 determines whether the user has inserted a coin. Of course, in a sophisticated embodiment of the present invention, the user may be required to input any type of monetary compensation such as paper money, credit cards or other type of charging mechanisms including an in-store or an in-facility charge and debit card. The term "coin" is meant to cover those embodiments. If from decision step 130 the NO branch is taken, the system conducts a timeout routine in step 132. Essentially, if the user has been displayed "insert coin" and has not inserted the coin within a certain period of time, the timeout clock in step 132 expires and the video program system cycles back to a point immediately preceding the display ad function 122.

If the YES branch is taken from decision step 130, the system displays in step 134, the points available for play by the user. As stated above, the deposit of $0.25 into the video game device 10 may result in the user being assigned five (5) points. If each row, column or diagonal requires a single point (1) to play, the user could play row 30, 31, 32; row 33, 34, 35; row 36, 37, 38; column 30, 33, 36; and, column 31, 34, 37. In step 136, the system, in game data messages display area 24 (FIG. 1), displays a prompting message and, in the matrix, highlights rows, columns and diagonals to enable the user to select which row, column and diagonal (r,c,d) he or she wishes to play. Step 137 is a user or operator input step wherein the operator selects which row, column or diagonal he or she will play. In step 139, the system decrements or reduces the "points available" counter (those points are "available for play" and stored in a counter is discussed above in connection with the Game Data Table) and increments the "points at risk" counter to notify the user how many points he or she has at risk during that round of play.

Decision step 140 determines whether the operator has selected start button 21. If not, the NO branch is taken and the system executes timeout step 141. Timeout step 141, after the timeout clock expires, executes the clear and restore "points available to play" in step 143. Thereafter, the system returns to a point preceding display "points available for play" to the user, that is, step 134.

If the YES branch is taken from decision step 140 indicating that the user has selected start button 21, the system jumps, via jump point J-1 to function step 142. Step 142 initializes the start point for each rotating cylinder in the database list. The start point is selected based upon the utilization an offset number from the RAM clock. Step 144 visually displays each spinning reel. It is important to know that each spinning cylinder or reel spins forever until the user selects stop button 17 (FIG. 4). Step 146 establishes the STOP ACTIVE setting for a particular reel or cylinder based upon the Programmed Stop Sequence for Display Grid Table set forth above. As explained earlier, the reels or cylinders stop are made available to stop (a STOP ACTIVE condition) in a predetermined or programmed order. In the present invention, the reel or cylinder in grid 33 stops first. The STOP ACTIVE sequence is as follows, grid 33, grid 34, grid 35, grid 30, grid 31, grid 32, grid 36, grid 37 and grid 38.

Decision step 148 determines whether the user has selected stop button 17 for the current STOP ACTIVE reel or cylinder. If not, the NO branch is taken and the system remains in a loop, spinning the reels or cylinders in an infinite manner (subject to the supply of power to video machine 10). If the YES branch is taken from decision step 149, in step 150, the system stops the spinning cylinder or reel subject to the STOP ACTIVE state and the pre-programmed time delay. This time delay is discussed above in connection with the Programmed Time Delay from Stop Command Table and in connection with the timing diagram in FIG. 5. In function step 152, the system displays the icon and adjacent icons in the cylinder that has stopped rotating in the particular grid. For example, in FIG. 3A for grid 31 at time $t_c$, the icon V is fully displayed and the icon Z is 98% fractionally displayed. In step 154, the system sets the STOP ACTIVE control for the next reel. If the grid region 31 was previously subject to the stop command, the next grid 32 has the STOP ACTIVE software indicator turned ON. This sequential stop sequence is set forth above in the Programmed Stop Sequence for Display Grid Table. Step 156 repeats steps 48, 50, 52 and 54 for all reels or cylinders.

In decision step 158, a determination is made by the video game program whether the user has matched any of the plurality of preset winning iconic combinations. If not, the NO branch is taken and, in decision step 161 a determination is made whether the system has a consolation sub-routine. A consolation sub-routine is a short form of the video play but permits the user to win some points rather than lose all points which were involved in that particular round of play. If YES, the system executes the play cancellation round function 162. If not, the NO branch is taken and the system in decision step 163 determines whether the player has any further "points available for play." If not, the system follows the NO branch and the program ends. If YES, the system jumps to jump point J-2 which is a point immediately preceding step 134 (FIG. 8A, the display points available to user).

If the player has won or matched a displayed iconic combination with a winning iconic combination (established and displayed to the user during the instruction phase) steps 125, 126, 127 and 128, the system executes step 165 which highlights the winning combination on grid matrix 28. In other words, if a winning combination includes the top row with icons AAA, and the user has displayed, on the top row 30, 31, 32, the icons AAA, all 100% displayed, and irrespective of any fractionally displayed icons, the user is declared "a winner." The computer system highlights or draws a red line through winning combination grid 30, 31, 32. In step 166, the system displays the winning combination also in game data message area 24, displays the points won by that combination, preferably displays the combination again in the game data messages display 24, and visually posts the number of points won by the player during that round of play. The system then jumps, via jump point J-3 to FIG. 8C.

The system then executes step 168 which decrements the "points won display" in message area 24 and increments the total points won by the player for the entire time that the player has engaged the video game machine 10. Step 170 displays a question "play again or redeem points?" to the user. Decision step 172 determines whether the player has activated the play button. If not, the system goes to the redeem function as noted by jump step 173. If YES, the system executes functional step 174 which repeats the play from jump point J-2 (FIG. 8A) and function step 134 until the player has zero points available to play. See Game Data Table above.

Figure 9:
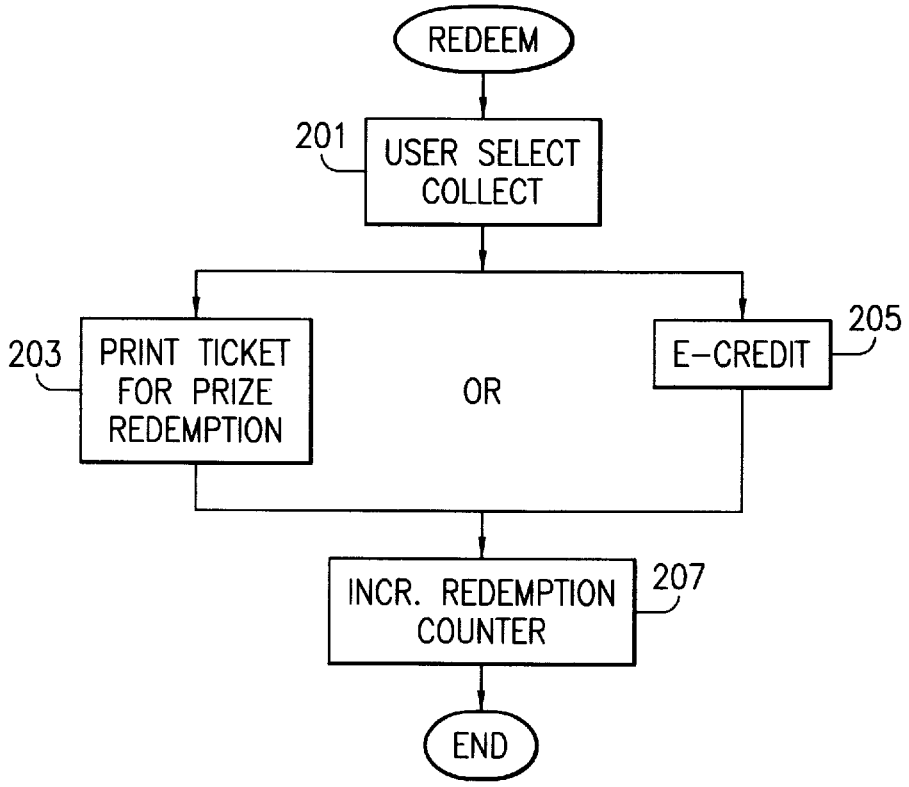
FIG. 9 diagrammatically illustrates the functional flow diagram for the redemption function in accordance with the principles of the present invention.

FIG. 9 diagrammatically illustrates the collect or redeem function. When the user selects collect button 18, the system executes step 201 indicating such keypad selection. The system then executes step 203 which is print ticket for a prize redemption via printer 74 in FIG. 4 or generate an electronic credit in step 205. This electronic credit can be redeemed for online or Internet provided prizes, or may include the user's name on a reputation bulletin board or "hall of fame." In step 207, the system increments the redemption counter in the video game program.

Figure 10:
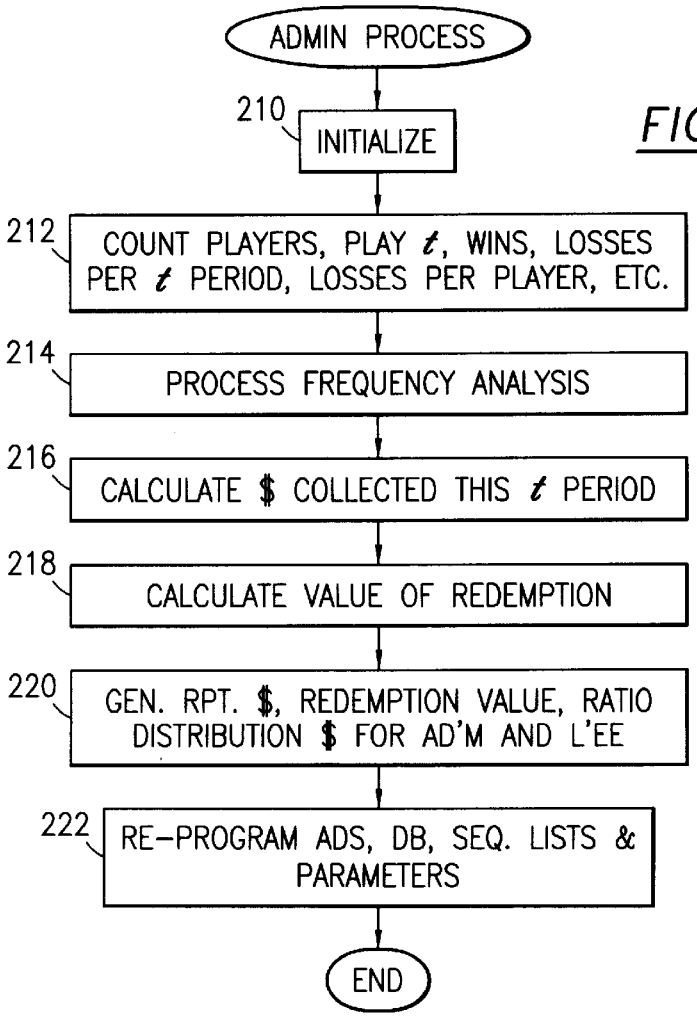
FIG. 10 diagrammatically illustrates a functional flow diagram of the administrative process for the video game program.

FIG. 10 diagrammatically illustrates an administrative process for the present invention. Step 210 initializes the system and monitors the system components. Step 212 counts the number of players who have played the game during a predetermined time period (per week, month, three months, etc.). Step 212 also determines the amount of play time per player, the amount of wins, losses per time period (days, week, months, etc.) and losses per player, among other things. Step 214 conducts a frequency analysis to determine the win/loss ratio, the player utilization ratio and other statistical analysis that may be necessary or reasonable for a particular utilization.

Step 216 calculates the amount of money or revenue collected by the video game device 10 during the subject time period. Step 218 calculates the value of redemption issued by the game program over that same time period. Step 220 generates a report indicating the amount of money or revenue collected, the redemption value, the ratio of revenues shared by the administrator and licensee. As explained above, the licensee is the retail establishment where video device 10 is located. The following Report Table provides examples of the types of reports that may be generated by video game device 10.

| Report Table |
|---|
| numbers of players per time period |
| numbers of daily players |
| average play time per player |
| average play time per player M, T, W, Th, F, S, S |
| average play per player |
| $ collected this period |
| redemption valve issued |
| ratio $ collected vs. redemption value |
| distribution of $ collected administrator vs. licensee |

Administrative step 222 enables the programmer to reprogram the advertisements in advertisement display region 26, change the iconic databases, the sequence list, the parameters and the other items discussed herein. Further, the programmer's function may generate a Programmer's Report Table as shown below.

| Programmer's Report Table |
|---|
| sequence listings |
| icon list |
| cylinder sequence sets |
| program stop sequence |

-continued

| Programmer's Report Table |
|---|
| program delay time |
| level progression time and sequence data |

As discussed above, the video game program may be configured to run on a personal computer or PC.

Figure 11:
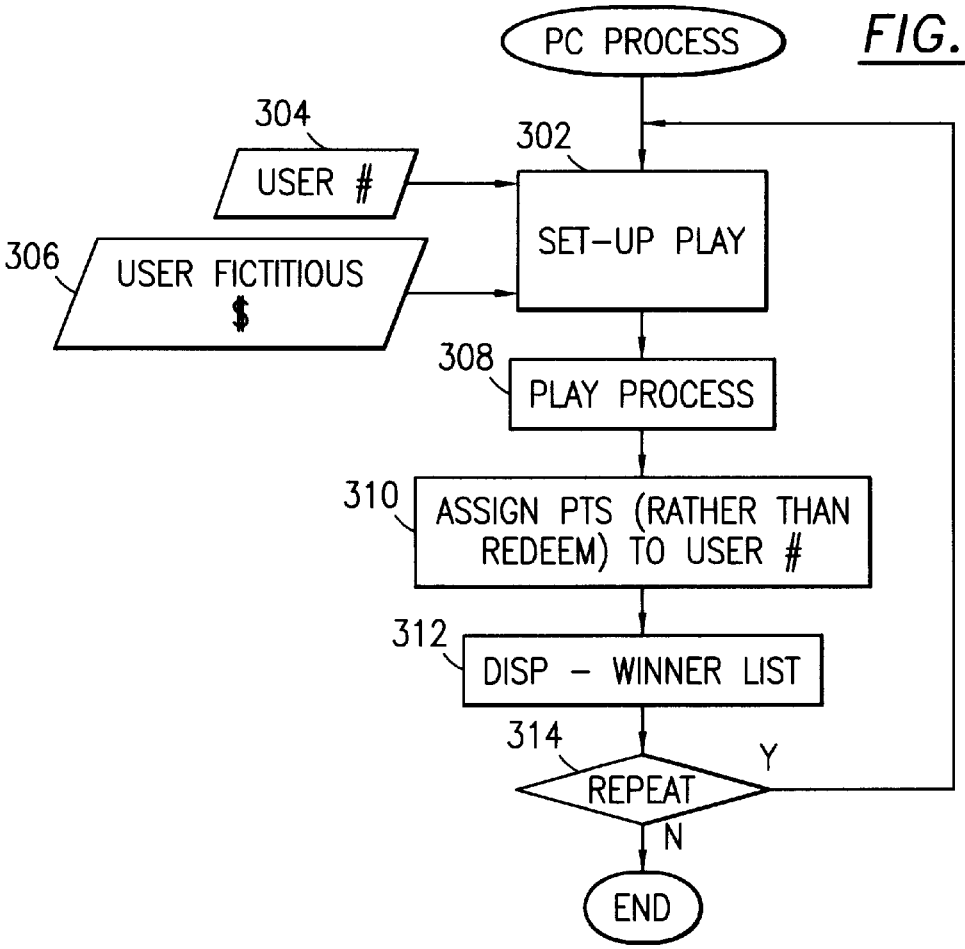
FIG. 11 diagrammatically illustrates a functional representation of the video game program configured for a personal computer (PC); and, FIG. 12 diagrammatically illustrates a functional flow diagram showing the implementation of the video game program on the global telecommunications computer network or the Internet.

FIG. 11 diagrammatically illustrates the major functional elements of the video program stored on a floppy disc, CD-ROM, DVD or other type of magnetic media. Functional step 302 excepts input from a user 304. The user would normally be required to input his or her name and/or select a name that has been previously input into the system. Setup play function 302 also accepts a user input 306 representing the fictitious amount of money that the user wishes to utilize in connection with the play of this video game. Function 308 activates the play process routine discussed above in connection with FIGS. 8A, 8B and 8C. Step 310 assigns points as a reward to the operator or user rather than issuing redemption coupons. These electronic assignments of points are posted to the user number inputs at step 304 above. In step 312, the system displays a winner list or a hall of fame for the operator. Decision step 314 determines whether the operator wants to repeat or replay the game. If the YES branch is taken, the system jumps to a point immediately preceding setup play function 302. If the NO branch is taken, the program ends.

Figure 12:
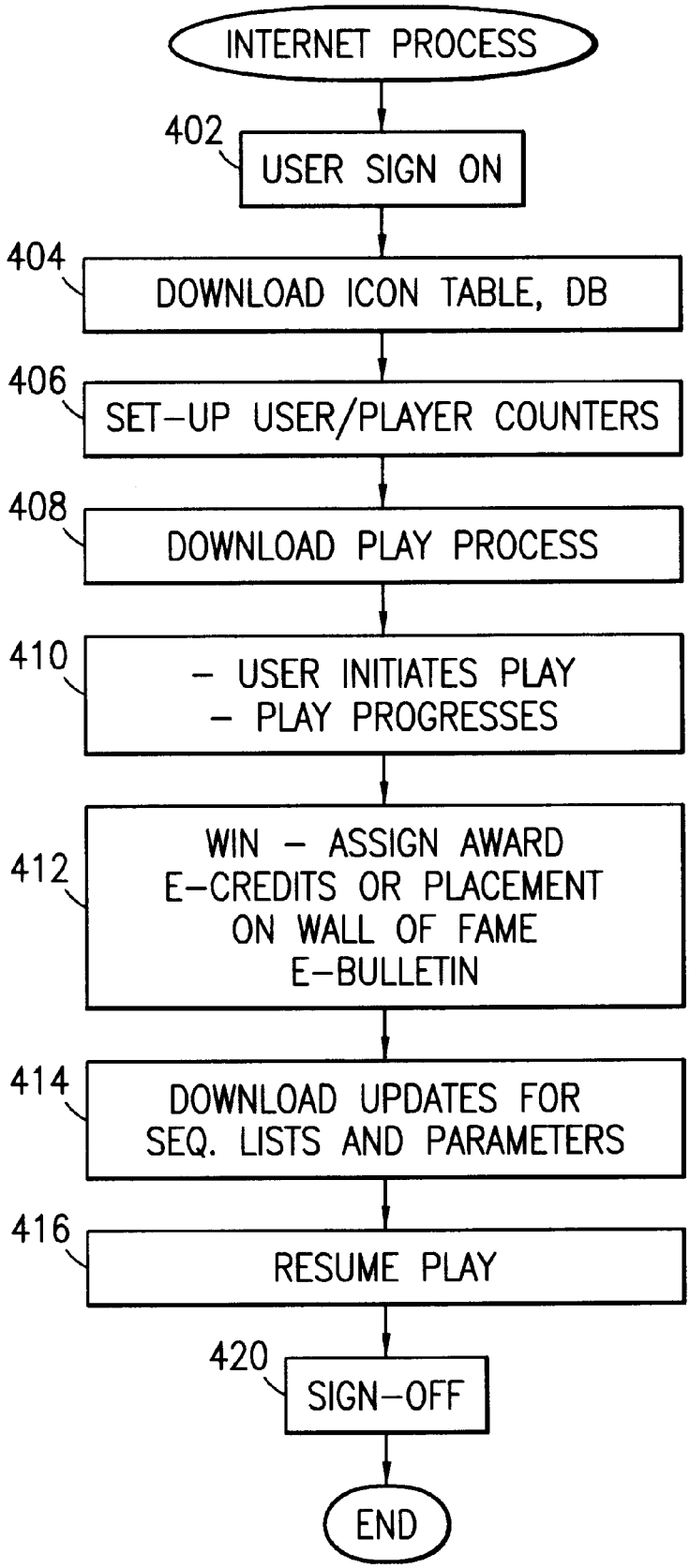

FIG. 12 diagrammatically illustrates the video game program and major functional elements when the program is implemented on the global telecommunications computer network or the Internet. In step 402, the user signs onto a website that maintains the video game program. Step 402 represents the download of the icon tables and databases. This download could include the entire image or pointers to other images. The amount of download information delivered to the operator or user's PC is directly related to the speed of information transfer and the number of users simultaneously accessing the Internet service provider and the web based program computer. A small number of users will enable the web based provider to download video images by multiple browser downloads. A large number of users would require a major download initially in step 404 and only minor browser interaction as play continues. In step 406, the program sets up the user and player counters on the user's machine. Step 408 downloads the play process discussed above in connection with FIGS. 8A–8C. It should be noted that parts of the program could be downloaded and other parts stored to be downloaded at later times. Step 410 recognizes that the user or operator initiates the play and that the play progresses. Step 412 results in a reward or/and award to the user based upon winning combination of icons. Step 412 provides electronic or E credit and representations of the user or player on a hall of fame or recognition bulletin board at the website. Function step 414 downloads any updates for sequential list or parameters in order to increase the difficulty of play to the player. Step 416 resumes play of the video game. Function step 420 represents the user signing off of the website.

The claims appended hereto are meant to cover modifications and changes within the scope and spirit of the present invention.

What is claimed:

1. A video game, played via a keypad and a monitor, which imitates a gambling slot machine but generates a video game output based upon play skills of an operator comprising:

a computer program including:

a display of at least a three grid matrix on said monitor;

video representations of a peripheral segment of a rotating cylinder in each grid of said matrix;

a plurality of iconic images in a predetermined and fixed sequence displayed, via said computer program, on each cylinder;

a view area in each grid of said matrix limited to a display of no more than one full display icon and a fractional display of no more than two icons;

an operator triggered stop command, a respective stop command associated with each rotating cylinder;

a pre-programmed, fixed period timer delaying the visual cessation of respective sequential icons on a corresponding rotating cylinder based upon said stop command, said timer not utilizing a random number generator, such that the delayed visual cessation of icons is predictable; and an award generator for rewarding said operator when one or more fully displayed icons, shown on a stopped cylinder in a respective grid of said matrix, match a predetermined one of a plurality of winning combinations of icons.

2. A video game as claimed in claim 1 wherein said plurality of iconic images exceed at least 12 icons.

3. A video game as claimed in claim 2 wherein said predetermined and fixed sequence of said plurality of iconic images includes repetitive and non-repetitive iconic images in said fixed sequence.

4. A video game as claimed in claim 3 wherein the display of said icons on said rotating cylinder visually appears to rotate at a constant speed.

5. A video game as claimed in claim 4 wherein said rotating cylinder visually slows during said visual cessation of said sequential icons.

6. A video game as claimed in claim 5 wherein each one of said plurality of fixed sequences is different.

7. A video game as claimed in claim 5 wherein each one of said plurality of fixed sequences is the same.

8. A video game as claimed in claim 5 wherein said plurality of icons is twenty-seven and said plurality of fixed sequences is three.

9. A video game as claimed in claim 5 including a printer, attached to said award generator, for generating a redeemable coupon for said operator.

10. A video game as claimed in claim 5 wherein said award generator generates an electronic award credit for said operator.

11. A video game as claimed in claim 10 including a recognition display, coupled to said award generator, listing electronic credits of said operator.

12. A video game as claimed in claim 5 wherein said grid matrix is at least a nine grid matrix.

13. A video game as claimed in claim 12 wherein said computer program includes a plurality of time delay periods, each time delay period associated with a respective grid in said matrix, said timer applying said corresponding time period delay to the visual cessation of said respective sequential icons on said corresponding rotating cylinder.

14. A video game as claimed in claim 13 wherein said computer program includes a play timer unique to said operator and said plurality of time delay periods includes a predetermined sequence of time delay periods which are applied to said timer for each corresponding rotating cylinder based upon said play timer.

15. A video game as claimed in claim 1 wherein said computer program is stored on an electronic medium.

16. A video game as claimed in claim 1 wherein said computer program is adapted to be transmitted over a global communications computer network.

17. A video game as claimed in claim 1 wherein said grid matrix is at least a nine grid matrix.

18. A video game as claimed in claim 1 wherein said computer program includes a plurality of time delay periods, each time delay period associated with a respective grid in said matrix, said timer applying said corresponding time period delay to the visual cessation of said respective sequential icons on said corresponding rotating cylinder.

19. A video game as claimed in claim 18 wherein said computer program includes a play timer unique to said operator and said plurality of time delay periods includes a predetermined sequence of time delay periods which are applied to said timer for each corresponding rotating cylinder based upon said play timer.

20. A video game, played via a keypad and a monitor, which imitates a gambling slot machine but generates a video game output based upon play skills of an operator comprising:

a computer program providing:

a display of at least a three grid matrix on said monitor;

video representations of a peripheral segment of a rotating cylinder in each grid of said matrix;

a fixed sequence of a plurality of icons displayed on each rotating cylinder;

each visible, peripheral cylindrical segment limited to a display of no more than one fully displayed icon and no more than two fractionally displayed icons at any given moment;

an operator triggered stop command for each rotating cylinder;

a pre-programmed, fixed period timer delaying the cessation of rotation of respective sequential icons based upon said stop command, said timer not utilizing a random number generator such that the delayed visual cessation of icons is predictable; and an award generator for rewarding said operator when one or more fully displayed icons, shown on a stopped cylinder, match a predetermined one of a plurality of winning combinations of icons.

21. A video game as claimed in claim 20 wherein a plurality of fixed sequences of icons are visually displayed on each respective rotating cylinder, wherein said plurality of icons is twenty-seven and said plurality of fixed sequences is three and wherein said grid matrix is at least a nine grid matrix.

22. A video game as claimed in claim 21 wherein said computer program includes a plurality of time delay periods, each time delay period associated with a respective grid in said matrix, said timer applying said corresponding time period delay to the cessation of rotation.

* * * * *